United States Patent [19]

Brand

[11] Patent Number: 4,669,618

[45] Date of Patent: Jun. 2, 1987

[54] LIFTING ASSEMBLY

[75] Inventor: William E. Brand, Kenosha, Wis.

[73] Assignee: Outboard Marine Corporation, Waukegan, Ill.

[21] Appl. No.: 799,325

[22] Filed: Nov. 18, 1985

[51] Int. Cl.[4] ..... B66C 13/06

[52] U.S. Cl. ..... 212/146; 294/1.1; 294/82.1

[58] Field of Search ..... 212/146, 167, 271; 410/101; 294/1.1, 68.1, 81.1, 81.52, 82.1

[56] References Cited

U.S. PATENT DOCUMENTS

| | | | |
|---|---|---|---|
| 781,096 | 1/1905 | Robertson | 212/167 |
| 795,902 | 8/1905 | Ferris | 294/1.1 |
| 1,321,742 | 11/1919 | Hendricks | 410/101 |
| 1,754,692 | 4/1930 | Miller | 294/1.1 |
| 1,845,707 | 2/1932 | Green | 294/82.1 |
| 2,346,277 | 4/1944 | Sherman | 294/1.1 |
| 2,552,219 | 5/1951 | Schleicher | 294/82.1 |
| 2,962,998 | 12/1960 | Long | 114/218 |
| 3,189,311 | 6/1965 | Hutchison | 248/361 |
| 3,888,190 | 6/1975 | Bigge | 410/101 |
| 3,893,399 | 7/1975 | Lewis et al. | 105/484 |
| 3,905,633 | 9/1975 | Larson | 294/1.1 |
| 4,074,519 | 2/1978 | Garrett | 294/1.1 |
| 4,160,541 | 7/1979 | Harken et al. | 114/218 |
| 4,295,765 | 10/1981 | Burke | 410/101 |
| 4,431,352 | 2/1984 | Andrews | 410/101 |

FOREIGN PATENT DOCUMENTS

| | | | |
|---|---|---|---|
| 2453815 | 12/1980 | France | 294/68.1 |

*Primary Examiner*—Galen Barefoot
*Assistant Examiner*—Stephen P. Avila
*Attorney, Agent, or Firm*—Welsh & Katz, Ltd.

[57] ABSTRACT

A lifting assembly for connection to a member to be lifted and to a filter hoist to first do the lifting and then to a second hoist to then do the lifting. The assembly comprises a base plate adapted to be connected to the member, and a lifting plate mounted on the base plate for pivotal movement about a horizontal axis, the lifting plate having a first eyelet adapted to be connected to one of the hoists, and a second eyelet adapted to be connected to the other of the hoists.

8 Claims, 3 Drawing Figures

LIFTING ASSEMBLY

BACKGROUND OF THE INVENTION

This invention relates to lifting assemblies for connection to a member to be lifted by a hoist and, more particularly, to lifting assemblies for connection to a member to belifted and to a first hoist to first do the lifting and then to a second hoist to then do the lifting.

Attention is directed to the following U.S. patents which disclose lifting or fastening devices.

| PATENTEE | U.S. Pat. No. | ISSUE DATE |
|---|---|---|
| Andrews | 4,431,352 | February 14, 1984 |
| Hendricks | 1,321,742 | November 11, 1919 |
| Green | 1,845,707 | February 16, 1932 |
| Schleicher | 2,552,219 | May 8, 1951 |
| Long | 2,962,998 | December 6, 1960 |
| Hutchison | 3,189,311 | June 15, 1965 |
| Lewis, et al. | 3,893,399 | July 8, 1975 |
| Ferris | 795,902 | August 1, 1905 |
| Bigge | 3,888,190 | June 10, 1975 |
| Burke | 4,295,765 | October 20, 1981 |
| Harken, et al. | 4,160,541 | July 10, 1979 |

Frequently, when a heavy member is lifted, a first hoist is used to initially lift the member and move the member horizontally a certain distance, and then the member is transferred to a second hoist to carry the member a second distance. Prior lifting assemblies did not provide means for easily fascilitating the transfer of the member and lifting assembly to a second hoist.

SUMMARY OF THE INVENTION

This invention provides a lifting assembly for connection to a member to be lifted and to a first hoist to first do the lifting and then to a second hoist to then do the lifting. The assembly comprises a base plate adapted to be connected to the member, and a lifting plate mounted on the base plate for pivotal movement about an axis generally parallel to the plane of the base plate, the lifting plate having a first eyelet adapted to be connected to one of the hoists, and a second eyelet adapted to be connected to the other of the hoists.

In one embodiment, the lifting assembly also includes a swivel member mounted on the base plate for rotational movement about an axis substantially normal to the base plate and the lifting plate is mounted on the swivel member.

In one embodiment, the base plate includes an opening and the swivel member extends through the base plate opening and has a first end with a radially outwardly extending flange, and a second end pivotally connected to the lifting plate. Further, the base plate has an indentation which receives the swivel member flange. The swivel member is elongated and the first end has a threaded indentation adapted to receive a threaded portion of the member to be lifted.

In one embodiment, the swivel member second end has a slot which receives the lifting plate, and the lifting plate has an opening located below the pair of eyelets and the lifting plate is pivotally mounted on the swivel member by a bolt received in the lifting plate opening and connected to the swivel member.

One of the principal features of the invention is the provision of a lifting assembly which is adapted to be connected to a heavy member and which provides for easy transfer of the heavy member from a first hoist to a second hoist.

Another of the principal features of the invention is the provision of such a lifting assembly which also permits turning of the member to be lifted when the member is lifted by the hoists.

Other features and advantages of embodiments of the invention will become known by reference to the following drawings, general description and appended claims.

Figure 1:
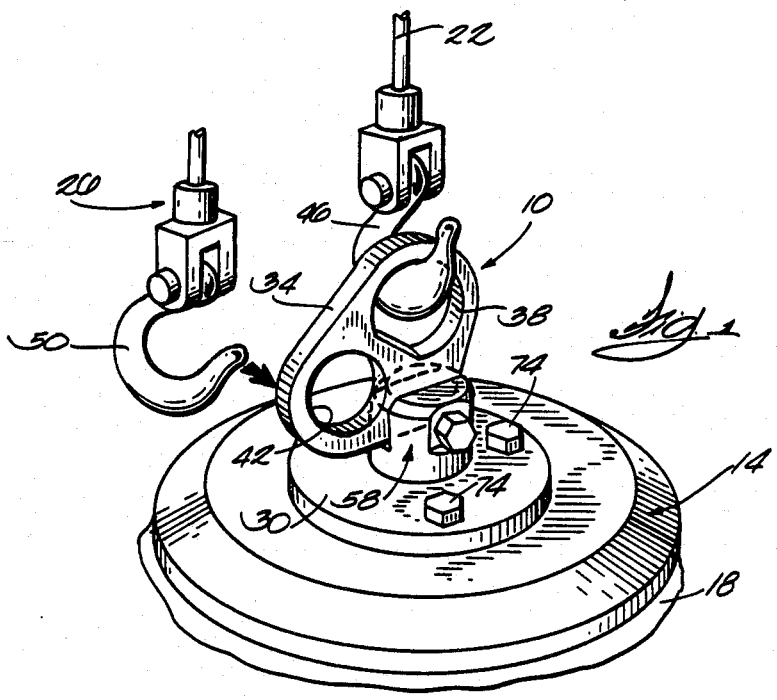
FIG. 1 is a perspective view of a member connected to a lifting assembly which embodies various of the features of the invention and which is adapted to be connected to a first hoist to do the lifting and then to a second hoist to then do the lifting.

Before an embodiment of the invention is explained in detail, it is to be understood that the invention is not limited in its application to the components set forth in the following description or illustrated in the drawings. The invention is capable of other embodiments and of being praticed and carried out in various ways. Also, it is to be understood that the phraseology and terminology employed herein is for the purpose of description and should not be regarded as limiting.

DESCRIPTION OF THE PREFERRED EMBODIMENT

Illustrated in the drawings is a lifting assembly 10 adapted to be connected to a member 14 such as a flywheel rotatably supported by an engine block 18. The lifting assembly 10 provides a ready attachment for means such as a first hoist 22 to first lift and transport the member 14, and then to a second hoist 26 to lift and then transport the member 14. Further, the lifting assembly 10 includes means for facilitating easy transfer of the member 14 and lifting assembly 10 from the first hoist 22 to the second hoist 26. More particularly, the fascilitating means comprises the lifting assembly 10 having a base plate 30 which is adapted to be connected to the member 14, and a lifting plate 34 mounted on the base plate 30 which is pivotal movement about a horizontal axis. The lifting plate 34 is generally triangular in shape and has a first eyelet 38 adapted to be connected to one of the hoists, and a second eyelet 42 adapted to be connected to the other of the hoists. In the illustrated embodiment, the second eyelet 42 is adjacent to the first eyelet 38, and the first eyelet 38 is larger than the second eyelet 42 so that each of the eyelets is adapted to be particularly connected to a different sized hoist hook.

When the lifting plate 34 having the pair of eyelets is pivoted in one direction, as illustrated in FIG. 1, the first eyelet 38 is available for connection to a hook 46 of the first hoist 22. The member 14 connected to the lifting assembly 10 can then be lifted and transferred a first distance. A hook 50 of the second hoist 26 may then be located in the second eyelet 42 and raised. When so raised, the lifting plate 34 is pivoted and the weight of the member 14 is transferred from the first hoist 22 to the second hoist 26. The first hoist hook 46 can then be easily lowered and removed from the first eyelet 38 thereby completing the transfer of the member 14 and lifting assembly 10 from the first hoist 22 to the second hoist 26.

Although other constructions can be used in other embodiments, the base plate 30 is generally circular, includes a central opening 54 (See FIG. 3), and the lifting plate 34 is mounted on the base plate 30 for pivotal movement about a horizontal axis and for rotational movement about a vertical axis. More particularly, the lifting assembly 10 also includes a swivel member 58 mounted on the base plate 30 for rotational movement about a vertical axis, and the lifting plate 34 is mounted on the swivel member 58 for pivotal movement about a horizontal axis.

Figure 3:
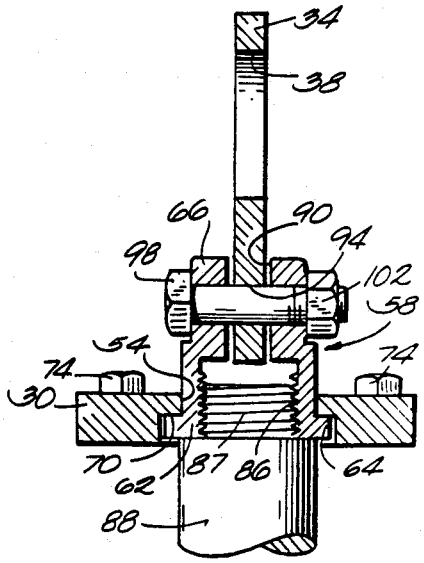
FIG. 3 is a cross sectional view of the lifting assembly taken along the line 3—3 in FIG. 2, only with the lifting assembly connected to a different member.

As illustrated in FIG. 3, the swivel member 58 is generally elongated and extends through the centrally located opening 54 in the base plate 30, and has a first end 62 with a radially extending flange 64, and a second end 66 which is pivotally connected to the lifting plate 34. By virtue of the radially outwardly extending flange 64 on the first end 62 of the swivel member 58, and the connection of the lifting plate 34 to the second end 66 of the swivel member 34, the swivel member 34 is secured within the base plate opening 54. The swivel member 58 is therefore free to rotate relative to the base plate 30, and to have some sliding movement within the base plate opening 54. Although other constructions can be used in other embodiments, the base plate 30 has an indentation 70 which receives the swivel member flange 64.

Figure 2:
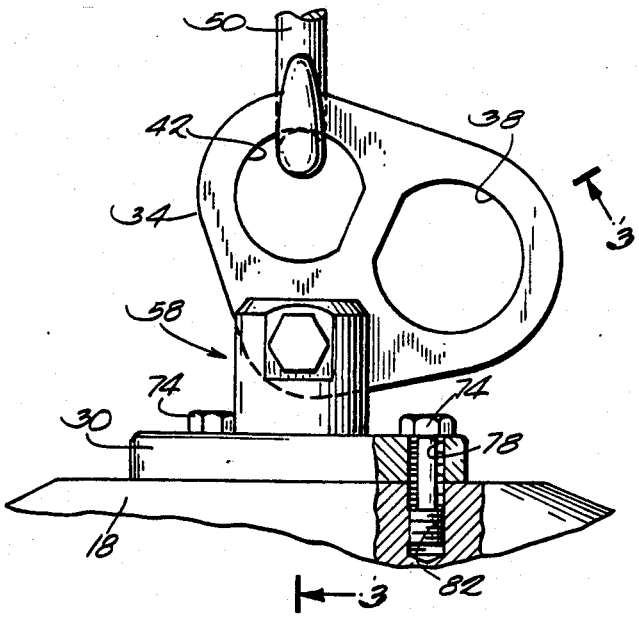
FIG. 2 is a side view partially broken away of the lifting assembly and member illustrated in FIG. 1.

In the illustrated embodiment, two separate mechanisms are provided for connecting the lifting assembly 10 to the member to be lifted. One such mechanism in the form of hardened bolts 74 (see FIG. 2) which are received in three spaced openings 78 (only one of which is shown) near the outer periphery of the circular base plate 30, and which are trapped within the base plate openings 78 in order to prevent the loss of the bolts 74. The bolts 74 are threaded and can be secured in openings 82 in the member 14 to be lifted, as illustrated in FIG. 2.

The second mechanism provided for connection of the lifting assembly 10 to a member to be lifted is in the form of the swivel member first end 62 having a centrally located threaded indentation 86 (see FIG. 3) which is adapted to receive a threaded portion 87 of a member 88 to be lifted. Obviously, either one or both of the connecting means included in the illustrated embodiment can be used. However, when the second mechanism 86 for connecting the lifting assembly to the member is used, turning of the member relative to the lifting assembly 10 is restricted.

The lifting plate 34 is pivotally connected to the swivel member 58 by means of the swivel member second end 66 having a slot 90 which receives the lifting plate 34, and the lifting plate 34 having an opening 94 located below the pair of adjacent eyelets. A bolt 98 passes through a pair of spaced aligned apparatuses in the swivel member 58, is received in the lifting plate opening 94, and is connected to the swivel member 58 by means of a nut 102 secured on the threaded end of the bolt 98.

Various other features of the invention are set forth in the following claims.

I claim:

1. A lifting assembly for connection to a load member so as to facilitate lifting of the load member by a first hoist hook and transfer of the load member to a second hoist hook while at least temporarily maintaining engagement of the lifting assembly with the first hoist hook, said assembly comprising a generally planar base plate adapted to be connected to the load member, said base plate having an opening therethrough defining a lift flange, a swivel member received through said base plate opening and having a generally radial flange thereon adapted to engage said lift flange while enabling rotation of said swivel member about an axis generally normal to said base plate, said swivel member having a longitudinal bore defining means enabling lifting connection of said swivel member to said load member independent of said base plate, a lift plate defining a pair of hoist hook receiving eyelets and having an opening therethrough enabling pivotal connection to said swivel member, and means pivotally connecting said lift plate to said swivel member such that connection of a hoist hook to said lift plate through either of said eyelets results in a lifting force acting substantially along the rotational axis of said swivel member, said lifting assembly being operative to enable transfer of said load member from a first hoist hook to a second hoist hook prior to disengagement from said first hoist hook.

2. A lifting assembly in accordance with claim 1 wherein said swivel member is elongated, and wherein said connection means comprises a threaded indentation adapted to receive a mutually cooperable portion of the member to be lifted.

3. A lifting assembly in accordance with claim 1 wherein said swivel member has a diametral slot which receives said lift plate therein, and wherein said opening in said lift plate is located below said pair of eyelets, said lift plate being pivotally mounted on said swivel member by a bolt received through said lift plate opening and connected to said swivel member.

4. A lifting assembly in accordance with claim 1 wherein said second eyelet is adjacent said first eyelet.

5. A lifting assembly in accordance with claim 1 wherein said base plate has a plurality of circumferentially spaced openings, and wherein said lifting assembly further includes a plurality of bolts, each of which is received in one of said plurality of base plate openings and is adapted to be connected to the member to be lifted.

6. A lifting assembly as defined in claim 1 wherein said lift flange defined by said base plate is substantially annular, said radial flange on said swivel member being annular and adapted for sliding engagement with said lift flange on said base member.

7. A lifting assembly as defined in claim 1 wherein said lift plate is generally triangular, said hoist receiving eyelets being disposed generally adjacent two corners of said lift plate and said opening therethrough being disposed adjacent the other corner thereof.

8. A lifting assembly as defined in claim 1 wherein said lift plate comprises an integral plate of generally triangular configuration, said pair of hoist receiving eyelets being of different size to accomodate different size hoist hooks.

* * * * *